US005117924A

United States Patent [19]

Bermingham

[11] Patent Number: 5,117,924

[45] Date of Patent: Jun. 2, 1992

[54] ENERGY TRANSFER UNIT FOR A PILE DRIVER

[75] Inventor: Patrick Bermingham, Dundas, Canada

[73] Assignee: Berminghammer Corporation Limited, Ontario, Canada

[21] Appl. No.: 641,662

[22] Filed: Jan. 15, 1991

[51] Int. Cl.[5] ..... B25D 9/06

[52] U.S. Cl. ..... 173/210; 173/131

[58] Field of Search ..... 173/81, 128, 131, 139

[56] References Cited

U.S. PATENT DOCUMENTS

| | | | |
|---|---|---|---|
| 2,936,743 | 5/1960 | Colgate | 173/128 |
| 3,498,391 | 3/1970 | Guild et al. | 173/131 |
| 3,881,557 | 5/1975 | Gendron et al. | 173/131 |
| 3,927,722 | 12/1975 | Frederick | 173/131 |
| 3,961,672 | 6/1976 | Welsch et al. | 173/131 |
| 4,072,199 | 2/1978 | Wanner | 173/131 |
| 4,340,120 | 7/1982 | Hauk et al. | 173/131 |
| 4,362,216 | 12/1982 | Jansz | 173/131 |
| 4,602,689 | 7/1986 | Wanner | 173/131 |

FOREIGN PATENT DOCUMENTS

| | | |
|---|---|---|
| 610447 | 12/1960 | Canada . |
| 650976 | 10/1962 | Canada . |
| 714278 | 7/1965 | Canada . |
| 787088 | 6/1968 | Canada . |
| 920384 | 2/1973 | Canada . |
| 948868 | 6/1974 | Canada . |
| 1008679 | 4/1977 | Canada . |

*Primary Examiner*—Frank T. Yost
*Assistant Examiner*—Scott A. Smith
*Attorney, Agent, or Firm*—Bell, Seltzer, Park & Gibson

[57] ABSTRACT

An energy transfer unit is designed for use in conjunction with a pile driving that has an impact block projecting from the lower end of the hammer casing and axially movable therein for transmitting energy from the hammer to a pile to drive the pile. The unit comprises a housing for rigid attachment in axial alignment with the casing of the hammer, the housing receiving and guiding the projecting portion of the pile driver impact block for axial movement therein. A striker plate is guided for axial movement in the housing and is adapted to be impacted by the impact block and to transfer and distribute the impact force from the pile driver evenly and directly to the head of the pile. Cushioning rings within the housing prevent impact between said striker plate and the pile driving hammer housing upon rebound of the pile, and thus prevent damage to the pile driver. The cushioning rings are formed of rubber and are carried at the upper end of the housing by a retainer ring which is engaged by the striker plate when it rebounds. Thus the rebound energy is absorbed by the rubber rings.

13 Claims, 3 Drawing Sheets

ENERGY TRANSFER UNIT FOR A PILE DRIVER

BACKGROUND OF THE INVENTION a) Field of the Invention

This invention relates to a new or improved drive cap for use in association with pile hammers or drivers, particularly diesel pile drivers, and also to a combination of the new drive cap with a pile driver.

b) Description of the Prior Art

In conventional pile hammers as shown in FIG. 1, the piston 10 sliding within the vertically oriented cylinder 11 is driven by an explosion of diesel fuel that has been compressed to its ignition point in the combustion chamber 12. An impact block 13 has a head 14 that extends from the lower end of the cylinder, the impact block being slidably received in the cylinder. The head 14 is positioned in contact with an arrangement of cushioning material 15 positioned in a recess on the upper side of a pile cap 16, the lower side of which has a recess to receive the upper end of the pile (not shown). The drive cap is slung below the hammer by cables (not shown) in such a fashion as to restrict the extent of which it can move away from the lower end of the cylinder and thus restrict the maximum extension of the impact block 13 with respect to the cylinder. This degree of movement is determined to be a point that allows the impact block to be displaced under the force of the exploding fuel change to drive the pile, without allowing the impact block to be forced out of the lower end of the cylinder.

The upper end of impact block forms the bottom of the combustion chamber. As the piston 11 falls, fuel is introduced into the combustion chamber 12. The falling ram or piston 11 compresses the fuel air mixture in the combustion chamber and ignites it, driving the piston upwards and the impact block downwards. The impact block accordingly applies a driving force to the head of the pile through the cushioning material 14 and the drive cap 16 to drive the pile into the ground.

There are two fundamental problems that limit the efficiency of existing diesel pile hammer designs. The first of these concerns the cushioning material which has to transfer energy from the impact block 13 to the pile in the driving direction, and also has to attentuate forces generated by a rebound of the pile, so that the hammer is not damaged by this effect, referred to as "wracking" which can result in greatly increased maintenance costs. In delivering energy to the pile, the function of the cushion material is to increase the period over the which the energy is transferred, to avoid damage due to high peak impact loads on the pile head. In other words, the object is to lower the peak forces created by the falling ram, thus protecting the head of the pile and pushing the pile into the ground faster by extending the time period over which the driving force is applied. In reality, however, a substantial quantity of the energy applied to the cushioning material is absorbed and dissipated as heat that first hardens and ultimately causes the material to deteriorate. Thus, the pile is robbed of some of the energy that should be applied to drive it into the ground. Additionally, the cushioning material, particularly as it hardens, does not efficiently prevent transfer of energy back to the hammer from rebound of the pile. The results are a pile that takes longer to be driven, and a hammer that requires excessive maintenance.

The second problem with existing designs concerns the weight of the drive cap. To overcome the destructive impact forces created by the falling piston and the ensuing transferred energy, drive caps are made of durable materials which are very dense. Accordingly, the typical weight of the cushioning material and drive cap amounts to between 1500 and 2000 pounds, and this weight rests entirely on the head of the pile. This weight in addition to the weight of the pile must be mobilized before any driving of the pile is accomplished, so that there is additional energy wasted in overcoming the inertia of the pile cap. Altogether, the combined effect of the problems discussed above is to waste up to 65% of the kinetic energy of the falling ram or piston, while increasing the effective inertia of the pile, and transferring damaging rebound energy back to the pile driver.

An energy transverse system of a pile driver should desirably drive the pile as efficiently as possible while minimizing power driver maintenance. Existing systems do not achieve these conditions.

SUMMARY OF THE INVENTION

The present invention provides an energy transfer unit for use in conjunction with a pile driving hammer of the type having an impact block projecting from the lower end of the hammer casing and axially movable therein for transmitting energy from the hammer to a pile to drive the pile, comprising: a) a housing for rigid attachment in axial alignment with the casing of the hammer, said housing being adapted to receive the projecting portion of the pile driver impact block for axial movement therein; b) a striker plate guided for axial movement in said housing and adapted to be impacted by said impact block and to transfer and distribute force from the pile driver evenly to the head of the pile; c) means for retaining said striker plate within said housing; and d) cushioning means within said housing to prevent impact between said striker plate and the pile driving hammer casing.

The invention also provides a pile driving hammer having a casing and an impact block projecting from the lower end of the said casing and axially movable therein for transmitting energy from the hammer to a pile to drive the pile, and further including: a) a housing rigidly attached in axial alignment with the casing of the hammer, said housing receiving the projecting portion of the pile driver impact block for axial movement therein; b) a striker plate guided for axial movement in said housing an adapted to contact on one side the head of a pile to be driven and to be impacted on its opposites side by said impact block, and to transfer and distribute force from the pile driver evenly to the head of the pile; c) means for retaining said striker plate within said housing; and d) cushioning means within said housing to prevent impact between said striker plate and the pile driver hammer casing.

In its preferred embodiments the energy transfer unit includes a housing that is tubular and is bolted to the lower end of the cylinder of the hammer. The housing can be designed to support a ring type wear bearing in the cylinder for sliding engagement with the impact block, and providing a means to prevent accidental withdrawal of the impact block from the cylinder through engagement with the sealing piston rings at the upper end of the impact block.

The striker plate preferably is a disc shaped steel member that is movable axially within the housing, being limited at the lower end by a removable annular collar. The cushioning means preferably comprises one or a series of annular rubber cushioning rings that surround the head of the impact block and are held at the upper end of the cylindrical housing by an annular retaining ring that is detachably supported on the wall of the housing. At the upper end of its range of movement the striker plate engages the retaining ring and thus transfers into the annular cushioning rings any rebound energy from the pile. This effectively eliminates the previously described "racking" action on the hammer cylinder.

In its preferred embodiments, the present invention allows substantially more energy to be transferred to the pile, while concurrently reducing damage on the hammer, and thus reducing maintenance costs. The striker plate may be of any suitable form, or may be replaced by various striking adapters to suit particular requirements. The striker plate or striker adapters act to equally distribute the force of the falling ram, and transfer the energy evenly to the head of the pile.

The retaining ring serves both to support and to align the cushioning rings, and is readily removable to permit the insertion of cushionary rings of different materials or configurations. The removability of the collar likewise allows for fast and easy interchange of the striker plate or plates.

The ability of energy the transfer unit to be attached directly onto the hammer, rather than slung below it as was the previous practice, is of great importance because it allows for precise alignment of the hammer with respect to the pile. The disclosed energy transfer unit effectively ensures that the energy is transferred only in one direction, i.e. the driving direction, and because of this it is possible to drive the pile more quickly.

The ability to interchange parts in the energy transfer unit specifically is of significant advantage since it reduces the down time of the machine.

The energy transfer unit can be constructed of durable yet relatively light materials, and this is of importance because it reduces the overall weight of the hammer.

BRIEF DESCRIPTION OF THE DRAWINGS

The invention will further be described by way of example only, with reference to the accompanying drawings, wherein.

DESCRIPTION OF THE PREFERRED EMBODIMENTS

Figure 2:
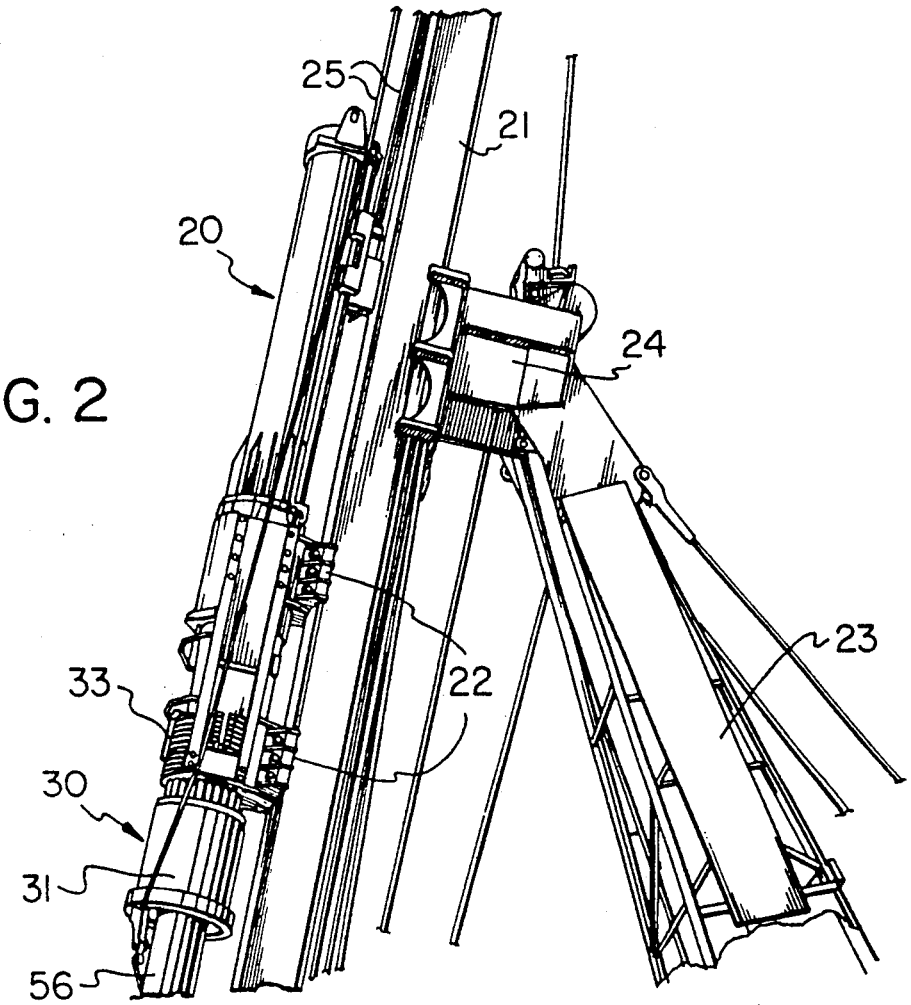
FIG. 2 is a side elevational view of a diesel pile hammer that includes an energy transfer unit in accordance with this invention, the pile driver being shown in association with guide leads and a pile to be driven.

With reference to FIG. 2, a pile driver 20 is guided for movement longitudinally of a leads beam 21 through mounting brackets 22, the leads beam in turn being supported from a crane boom 23 by an adjustable attachment structure 24. Movement of the pile driver along the leads beam is controlled in known manner by a system of cables 25.

Figure 3:
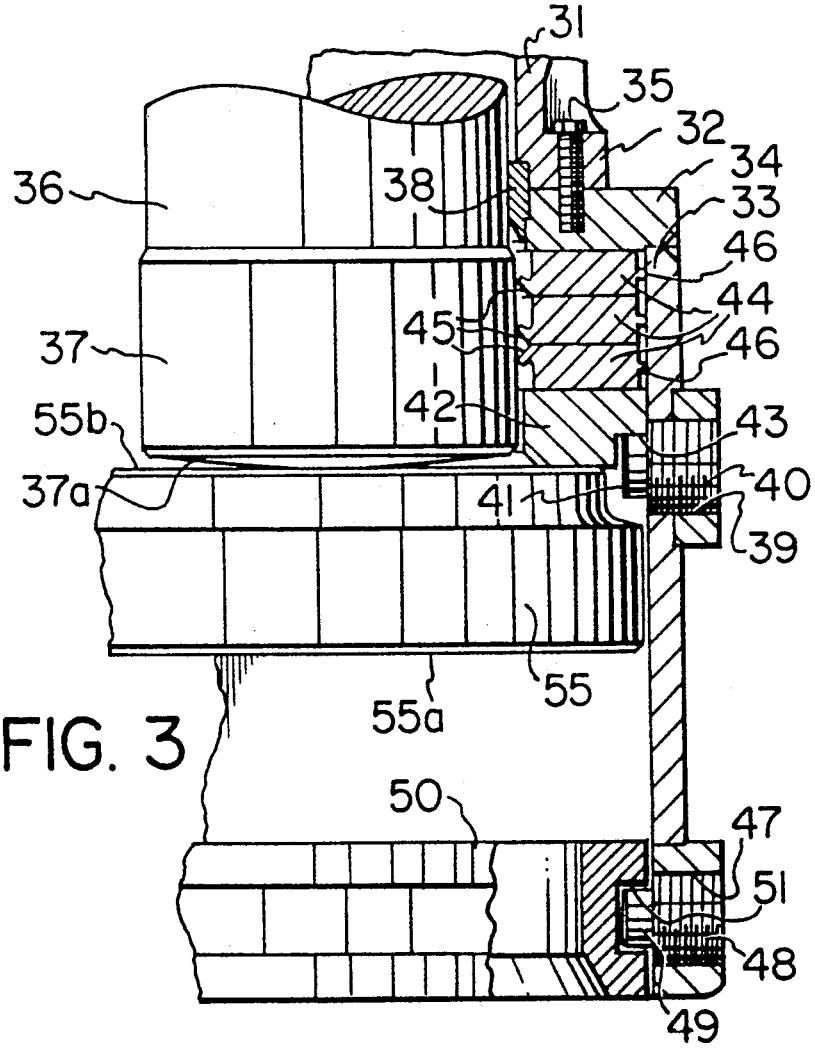
FIG. 3 is an enlarged longitudinal sectioned half view of the energy transfer unit of FIG. 2.

The pile driver hammer 20 is a diesel driven unit and is not described in detail herein since it is of essentially conventional construction except for the energy transfer unit, which will now be described with reference to FIGS. 2, 3 and 4. As shown in FIG. 2, the energy transfer unit 30 has a cylindrical form, and is attached to the lower end of the pile driver 20. Specifically, the cylinder 31 of the hammer has an open lower end formed with a peripheral flange 32. The energy transfer unit has a cylindrical wall 33 the upper end of which has an inwardly directed annular flange 34 which abuts the cylinder flange 32 which receives in threaded engagement a series of cap screws 35 by means of which the energy transfer unit 30 is rigidly attached to the lower end of the cylinder in axial alignment therewith.

Figure 1:
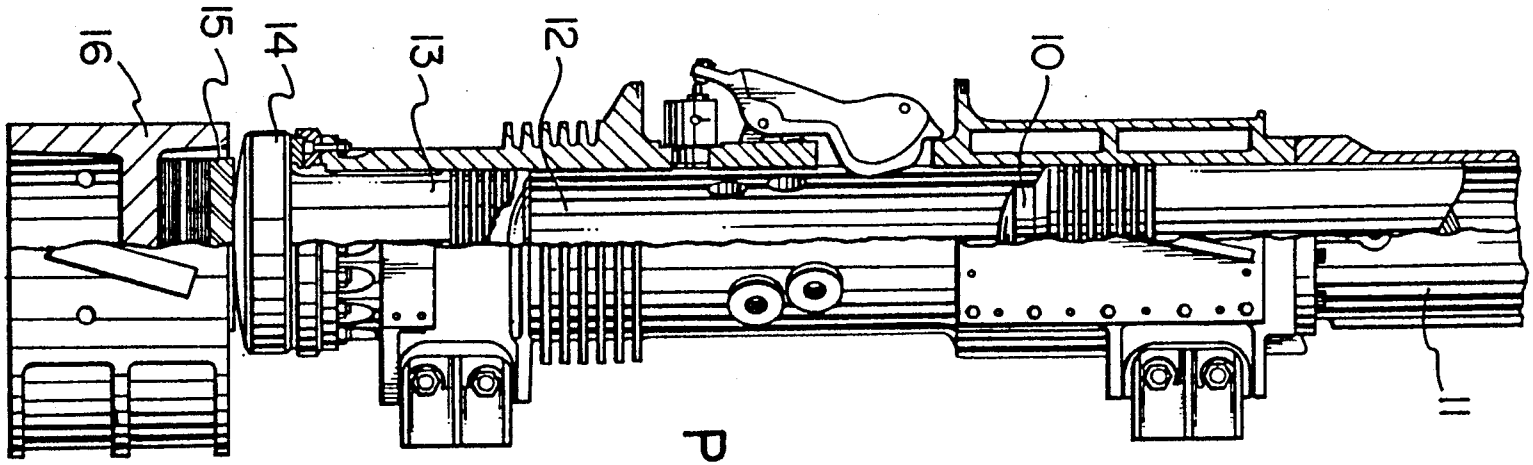
FIG. 1 PRIOR ART
FIG. 1 is fragmentary longitudinal half-section view of a prior art diesel pile hammer.

In the lower end of the hammer cylinder 31 is positioned an impact block 36 (similar in form to but lighter than the block 13 shown in FIG. 1) having an enlarged head 37 protruding from the lower end of the cylinder. The impact block 36 is guided for axial movement with respect to the cylinder 31, extension of the block from the cylinder being limited by an inner end wear bearing in the form of a ring 38 that it is seated between the flanges 32 and 34. As well as acting as seal, the ring 38 serves to keep the impact block properly aligned. Interference between the ring 38 and the piston rings (not shown) on the upper end of the impact block 36 prevents removal the latter from the cylinder 31.

At an intermediate location in its height, the cylindrical wall 33 of the energy transfer unit is pierced by four uniformly spaced collared holes 39 each of which is screw-threaded to be engaged by a short bolt 40 having a reduced cylindrical head 41 that projects into the interior of the housing. An annular retaining ring 42 positioned within the housing 30 has a peripheral shoulder 43 by means of which the ring is seated on and supported by the bolt heads 41. Between the upper side of the retaining ring 42 and the underside of the flange 34 is positioned cushioning material in the form of three annular rings 44 of a resilient material such a rubber or the like, the rings having inner and outer peripheral lips 45 or 46 respectively which press against the impact block 36 and the cylindrical wall 33. These lips 45, 46 act as auxiliary seals (in addition to the bearing ring 38 and the piston rings of the impact block) to limit the egress of products of combustion, lubricants, etc. through the lower end of the cylinder 31.

The rings 44 are preferably of a resilient urethane material that is resistant to oil and hydrocarbon solvents and preferably has a hardness in the range 70 to 80 durometer. The rings have a thickness that in not more than half of their width. It is preferred to use a number of such relatively thin rings 44 since a single unitary ring of the same overall thickness would eventually be destroyed by the heat generated by hysterisis in use. In contrast, the rings 44 being separate can expand and compress individually and are therefore subjected to less strain.

At the lower end of the energy transfer unit there a further four equiangularly spaced collared holes 47, each of which is likewise threaded to receive a threaded bolt 48 having a reduced cylindrical head 49 projecting to the interior of the cylindrical wall 33. An annular end collar 50 has a peripheral groove 51 designed to receive the bolt heads 49, which thereby function to releasable retain the collar 50 in place at the lower end of the energy transfer unit.

A flat sided disk-like striker plate 55 is positioned within the unit 30 to be freely movable axially therein between limiting positions defined, in the upwards direction by abutment of the plate 55 with the retaining ring 42, and in the downwards direction by abutment of the plate 55 with the end collar 50. The striker plate 55 is fabricated in any suitable hard, tough and shock resistant steel, and can be relatively light, e.g. of the order of 500 lbs. A suitable material for the plate 55 is ASTM 4340 steel, heat treated and stress relieved. However for use in frigid environments a different steal have greater shock resistance may be preferred. In operation, the leads beam 21 is positioned in alignment with the pile 56, and the pile driver is then lowered until the head of the pile passes through the lower end of the unit 30 within the end collar 50 and contacts the underside 55*a* of the striker plate 55, which at this time will be resting upon the end collar 50. As the power driver 20 is lowered further, the unit 30 will move downwardly relative to the striker plate 55 until the top face of 55*b* of the latter comes into engagement with the lower face of the retainer ring 42 which provides as abutment to support the weight of the pile driver upon the top of the pile. If during this movement the upper face 55*b* of the striker plate should first come into contact with the crowned lower surface 37*a* of the impact block head, then the latter will be immobilized so that the pile driver will move downwardly relative to it until the retainer ring 42 contacts the striker plate 55.

From this position, when the pile driver is operated the ram or piston falls, igniting the fuel mixture in the combustion chamber, the resultant explosion serving to drive the impact block 36 against the striker plate 55 which in turn imparts the impact energy to the upper end of the pile 56, driving it downwardly. The distance by which the striker plate 55 is driven downwardly with each power stroke will depend upon the prevailing conditions, but generally will be selected to be less than the displacement required to move the striker plate 55 into contact with the end collar 50. In any event the striker plate 55 will be retained within the energy transfer 30 by this end collar.

As will be understood, the pile driver piston or ram is projected upwardly within the cylinder by the explosion, and at a predetermine point in the upward stroke uncovers exhaust ports through which the combustion products escape allowing the pressure within the cylinder to drop. When this occurs, the impact block 36 is no longer urged strongly downwardly by the cylinder pressure, and instead the entire pile driver 20 and energy transfer unit 30 are free to move downwardly under the force of gravity until the striker plate 55 returns to the same relative position as shown in FIG. 3.

In very tough driving conditions (N=20 + i.e. requiring 20 or more blows to advance the pile by one inch and requiring therefore three minutes or more to drive the pile one foot) there is a tendency for some of the energy transmitted to the pile to be returned to the pile driver by rebound of the pile. When this occurs with the arrangement disclosed, the striker plate 55 is forced upwardly coming into contact with the retaining ring 42 which can yield in the upwards direction because of the resilience of the rings 44 (the bolts 40 prevent the retaining ring 42 moving downwardly from the position shown in FIG. 3). As the reverse rebound energy is imparted to the retaining ring through the striker plate, the resilient rings 44 provide a cushion that is effective to attenuate and absorb the impact load so that the cylinder 31 of the pile driver does not experience damage due to impact loads.

When it becomes necessary to change the striker plate 55, the end collar bolts 48 are removed so that the collar 50 can be withdrawn allowing the striker plate to removed. Now any appropriate striker adapter (not shown) designed for various pile types, can be inserted into the lower end of the energy transfer unit 30, whereafter the end collar 50 can be reattached. A similar procedure is followed when the impact block 36 or the resilient rings 44 or the wear ring 38 are to be removed. In this case, of course the bolts 40 are also withdrawn with allow removal of the retaining ring 40 and the other components.

Figure 4:
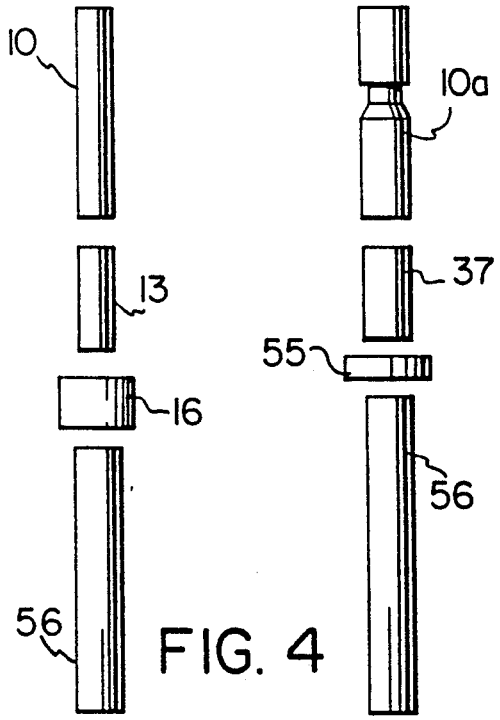
FIG. 4 is a schematic diagram illustrating energy transfer properties of a pile driver having an energy transfer unit in accordance with the present invention.

FIG. 4 is an underneath plan view of the lower end of the energy transfer unit housing, and shows the arrangement of the collared holes 47 and the holes to receive the cap screws 35.

Because of the improved design of the disclosed energy transfer unit, the energy of the power stroke of the impact block is transmitted efficiently to the head of the pile through the striker plate 55 so that, in contrast to the arrangement wherein this energy is transmitted through cushioning material, the energy dissipated is very little. Furthermore, since the striker plate 55 is relatively small, very little of the impact energy is dissipated in mobilizing this part, and a high proportion of the impact energy is applied to the pile.

FIG. 4 gives a schematic representation of the energy transfer system of a pile driver, the system of the present invention being shown in the right hand side, and the prior art system being shown in the left hand side of the figure. The essential elements of the system as shown in the left hand side of the figure comprise the hammer 10, the impack block 13, the pile cap 16, and the pile itself 56. The maximum energy in the system is the potential energy of the hammer 10 when it reaches the top of its stroke as a result of ignition of the combustion mixture within the cylinder. The kinetic energy transferred to the impact block 13 by the descending hammer is about 70% of the maximum potential energy since there are losses incurred in compression of gases within the cylinder by the descending piston, and also in the impact blow itself. Because of the nature of the pile cap, substantial losses occur so that the energy actually transferred to the pile 56 represents only about 30% to 60% of the maximum potential energy (i.e. 43 to 86% of the kinetic energy). In contrast, with the energy transfer system according to the invention as represented in the right hand of the figure, the energy transferred to the pile 56 is more constant, and typically will be about 90%, or within the range 85 to 95% of the kinetic energy, i.e. about 60 to 66% of the potential energy. Thus, the energy transfer system according to the invention not only imparts a significantly higher amount of the available energy to the pile, but does so in a more predictable manner, in terms of the relatively narrow range of variation. Accordingly, in addition to the improved efficiency, the system of the present invention allows for more accurate prediction of the loading capacity of the pile once installed.

It is proposed that the energy transfer system should include an energy measuring device employing spaced sensors in the wall of the cylinder, these sensors being operated in sequence by the descending piston so that through suitable electronic circuitry the speed of the descending piston at impact can be measured, and hence the kinetic energy transferred can be calculated. The energy in the ram can be varied by throttle control of the hammer to provide the required measure of kinetic energy leading to a predictable amount of energy being imparted to the pile. In the prior art, because of the very large range of variation, it was impossible to predict with any accuracy the amount of energy being transferred to the pile, and therefore it was necessary to over cushion the pile to avoid the possibility of the pile being damaged.

As mentioned, the weight saving possible by the improved energy transfer system is significant. The striker plate 55 in a typical application would weigh about 500 pounds as compared to 1500 to 2000 pounds for the pile cap 16. Additionally with the system in accordance with the invention the weight of the impact block itself is reduced by about 250 pounds so that the total weight savings may be of the order of one ton.

What I claim as my invention is:

1. An energy transfer unit for use in conjunction with a pile driving hammer of the type having a hammer casing having an upper end and a lower end, an impact block projecting from the lower end of the hammer casing said impact block having a generally cylindrical periphery and being axially movable in the lower end of the hammer casing for transmitting energy from the hammer to a pile to drive the pile, comprising:

a) a housing for rigid attachment in axial alignment with the casing of the hammer, said housing having an upper end and a lower end and being adapted to receive the projecting portion of the pile driver impact block for axial movement therein;

b) a striker plate guided for axial movement in said housing and adapted to be impacted by said impact block and to transfer and distribute force from the pile driver evenly to the head of the pile;

c) means for retaining said striker plate within said housing; and d) cushioning means within said housing to prevent impact between said striker plate and the pile driving hammer casing, said cushioning means comprising a plurality of annular rings of resilient material position within the upper end of said housing for engagement by said striker plate when the latter moves upwardly during rebound, said rings being stacked one above the other and being positioned with clearance between the periphery of said impact block and a surrounding wall of said housing, such that the material of said rings can expand radially when said rings are compressed by bound energy of said striker plate.

2. An energy transfer unit according to claim 1 wherein said housing is of cylindrical form, said cushioning means being located on the inside of said housing adjacent its upper end, said annular rings being of synthetic rubber and each having a thickness that is not more than half of its width.

3. An energy transfer unit as claimed in claim 1 wherein said annular rings are removably carried and supported by an annular retaining ring that is releasably engaged to the housing.

4. An energy transfer unit as claimed in claim 3 wherein said housing has a cylindrical wall and wherein said retaining ring is releasably connected thereto by fastener means inserted in openings in said cylindrical wall.

5. An energy transfer unit as claimed in claim 4 wherein said fastener means comprise bolts that are in threaded engagement with radial holes in said cylindrical wall and have heads that project into the interior of said cylindrical casing.

6. An energy transfer unit as claimed in claim 1 wherein an annular guiding and sealing ring is supported between the upper end of said housing and the lower end of the hammer casing for sliding sealing engagement with the periphery of the impact block.

7. An energy transfer unit as claimed in claim 1 wherein said means for retaining said striker plate within said housing comprises an annular collar detachably mounted within the lower end of said housing and having an unobstructed central opening of a diameter that is substantially smaller than the maximum diameter of said striker plate, but greater than the cross-section of the pile that is to be driven.

8. An energy transfer unit according to claim 7 wherein said collar is supported by means of threaded fasteners engaged in radial holes in said housing.

9. An energy transfer unit as claimed in claim 1 wherein said cushioning means includes annular lip seals for contact with the periphery of said impact block and with the internal surface of said housing to form sealing engagements therewith.

10. An energy transfer unit according to claim 1 wherein the cross section of each said ring has a width in the radial direction that is not less than twice its thickness in the axial direction.

11. An energy transfer unit according to claim 10 wherein at least one said ring has a circumferentially extending lip that is in sliding contact with the periphery of said impact block.

12. An energy transfer unit according to claim 10 wherein at least one said ring has a circumferentially extending lip in contact with the periphery of said impact block and at least one said ring has an outer circumferentially extending lip in contact with said surrounding wall of the housing, and wherein said rings are of a synthetic rubber material.

13. A pile driving hammer having a casing that has an upper end and a lower end, an impact block projecting from the lower end of the said casing and axially movable therein for transmitting energy from the hammer to a pile to drive the pile, and further including:

a) a housing rigidly attached in axial alignment with the casing of the hammer, said housing receiving the projecting portion of the pile driver impact block for axial movement therein;

b) a striker plate guided for axial movement in said housing an adapted to contact on one side the head of a pile to be driven and to be impacted on an opposite side by said impact block, and to transfer and distribute force from the pile driver evenly to the head of the pile;

c) means for retaining said striker plate within said housing; and d) cushioning means within said housing to prevent impact between said striker plate and the pile driver hammer casing, said cushioning means comprising a plurality of annular rings of resilient material position within the upper end of said housing for engagement by said striker plate when the latter moves upwardly during rebound, said rings being stacked one above the other and being positioned with clearance between the periphery of said impact block and a surrounding wall of said housing, such that the material of said rings can expand radially when said rings are compressed by rebound energy of said striker plate.

* * * * *

UNITED STATES PATENT AND TRADEMARK OFFICE

CERTIFICATE OF CORRECTION

PATENT NO. : 5,117,924

DATED : June 2, 1992

INVENTOR(S) : Patrick Bermingham

It is certified that error appears in the above-identified patent and that said Letters Patent is hereby corrected as shown below:

Column 7, line 50, "bound" should be -- rebound --.

In the Abstract, line 2, "driving" should be -- driver --.

Column 1, line 52, omit "the" (first occurrence).

Column 2, line 50, "an" should be -- and --.

Column 2, line 51, "opposites" should be -- opposite --.

Column 3, line 29, after "than" insert -- being --.

Column 4, line 26, omit "it".

Column 4, line 31, after "removal" insert -- of --.

Column 4, line 43, "a" should be -- as --. (second occurrence).

Column 4, line 54, "in" should be -- is --.

Column 4, line 62, "a" should be -- are --.

Column 4, line 68, "releasable" should be -- releasably --.

Column 3, line 28, after "of" insert -- the --; and after "energy" insert -- of --.

UNITED STATES PATENT AND TRADEMARK OFFICE

CERTIFICATE OF CORRECTION

PATENT NO. : 5,117,924

DATED : June 2, 1992

INVENTOR(S) : Patrick Bermingham

It is certified that error appears in the above-identified patent and that said Letters Patent is hereby corrected as shown below:

Column 5, line 13, "steal have" should be -- steel having --.

Column 5, line 24, "as" should be -- an --.

Column 5, line 47, "predetermine" should be -- predetermined --.

Column 6, line 7, after "to" insert -- be --.

Column 7, line 43, "position" should be -- positioned --.

Column 8, line 48, "an" should be -- and --.

Column 8, line 59, "position" should be -- positioned --.

Signed and Sealed this

Fifth Day of April, 1994

Bruce Lehman

*Attest:*

BRUCE LEHMAN

*Attesting Officer*

*Commissioner of Patents and Trademarks*